US007954913B2

(12) United States Patent
Gunnerson et al.

(10) Patent No.: US 7,954,913 B2
(45) Date of Patent: Jun. 7, 2011

(54) MOLDED PLASTIC SUPPORT FRAME FOR A DRAWER-TYPE DISHWASHER

(75) Inventors: Kory A. Gunnerson, West Lafayette, IN (US); Kristen K. Hedstrom, Orlando, FL (US); Mark E. Palm, Davie, FL (US); John R. Sanderson, Oakland Park, FL (US); Rodney M. Welch, Beach Bluff, TN (US); Kurt W. Wight, Ann Arbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 999 days.

(21) Appl. No.: 11/822,940

(22) Filed: Jul. 11, 2007

(65) Prior Publication Data

US 2009/0015118 A1 Jan. 15, 2009

(51) Int. Cl.

| | |
|---|---|
| ***A47B 77/06*** | (2006.01) |
| ***A47K 1/04*** | (2006.01) |
| ***A47L 19/02*** | (2006.01) |
| ***E03C 1/18*** | (2006.01) |

(52) U.S. Cl. ..... 312/228; 134/56 D; 134/57 D; 312/228.1

(58) Field of Classification Search ..... 312/228–228.1
See application file for complete search history.

(56) References Cited

U.S. PATENT DOCUMENTS

| | | | | |
|---|---|---|---|---|
| 3,844,441 | A | 10/1974 | Clark | |
| 4,179,307 | A | 12/1979 | Cau et al. | |
| 4,295,692 | A | 10/1981 | Jenkins | |
| 6,398,495 | B1 | 6/2002 | Kazianus | |
| D460,224 | S | 7/2002 | Richardson | |
| 6,447,081 | B1 | 9/2002 | Sargeant et al. | |
| 6,491,049 | B1 | 12/2002 | Tuller et al. | |
| 6,546,942 | B2 | 4/2003 | Smith et al. | |
| 6,571,808 | B2 | 6/2003 | Todd | |
| 6,622,740 | B1 | 9/2003 | Durazzani | |
| 6,666,531 | B2 | 12/2003 | Flowers | |
| 6,736,470 | B2 * | 5/2004 | Manke et al. | 312/228 |

FOREIGN PATENT DOCUMENTS

| | | |
|---|---|---|
| WO | 98/33426 | 8/1998 |

* cited by examiner

*Primary Examiner* — Michael Barr
*Assistant Examiner* — Jason Y Ko
(74) *Attorney, Agent, or Firm* — Diederiks & Whitelaw PLC; Robert A. Bacon

(57) ABSTRACT

A support frame for a drawer-type dishwasher includes a top section and opposing side sections formed from a plurality of support members which define an open lattice work and establish a cavity for a slidable dishwasher drawer. The support frame also includes first and second rail supports that are provided on respective ones of the opposing side sections. The first and second rail supports are designed to support corresponding first and second extensible rails which, in turn, support the wash tub for movement relative to the frame. In addition, the support frame includes lid support elements for a mechanism that provides shifting of a lid member relative to the wash tub.

14 Claims, 7 Drawing Sheets

MOLDED PLASTIC SUPPORT FRAME FOR A DRAWER-TYPE DISHWASHER

BACKGROUND OF THE INVENTION

1. Field of the Invention

The present invention pertains to the art of dishwashers and, more particularly, to a molded plastic support frame for an under-the-counter drawer-type dishwasher.

2. Discussion of the Prior Art

In general, dishwashers having a pull-out drawer supported in a cabinet are known in the art. The dishwasher may include a single, pull-out drawer or wash tub or, in some cases, the dishwasher will include an upper, pull-out drawer forming a first wash tub for washing dishware and, a lower pull-out drawer forming a second wash tub that can be used to supplement the first wash tub. In any event, known drawer-type wash tubs are mounted to extensible rails that are carried by or mounted to an enclosed cabinet. Typically, the cabinet is positioned under a kitchen countertop adjacent to cabinetry or other kitchen appliances.

Manufacturers of home appliances face a highly competitive market. Thus, there is a constant struggle to reduce both the number and complexity of various parts of the appliance, as well as to lower costs associated with manufacturing without detracting from an established level of quality. One method found to reduce both the number of parts and manufacturing costs is to re-evaluate the type of materials used to construct the appliance. One area of investigation has focused on the enclosed cabinet and associated structure.

Given that a dishwasher is placed under a kitchen countertop adjacent to cabinetry, walls or other appliances, there is no need for an enclosed cabinet. In recognition of this fact, manufacturers of conventional dishwashers have done away with the enclosed cabinet and developed an assembly which mounts a washing tub on minimal support structure that is positioned under the countertop. While this solution is fine for conventional dishwashers, drawer-type dishwashers require specific structure for supporting extensible rails that enable one or more wash tubs to slide in and out. In addition, structure must be provided for raising and lowering one or more lid members that seal against upper peripheral lips of the wash tubs during a washing operation.

Based on the above, there exists a need for a low cost, easily manufactured frame for a drawer-type dishwasher that includes specific structure for supporting a laterally movable washing chamber and a vertically shiftable lid member.

SUMMARY OF THE INVENTION

The present invention is directed to a support frame for a drawer-type dishwasher. In accordance with the invention, the support frame includes a top section, opposing side sections and a bottom section that are preferably formed from plastic, but which can be formed from metal, fiberglass or the like. The top section is joined to an upper portion of each of the opposing side sections so as to, at least partially, define a cavity for receiving a wash tub. Each of the opposing side sections is furnished with a plurality of support members that define an open lattice work. The open lattice work provides structure that contributes to the overall stability of the support frame.

In accordance with a preferred embodiment of the present invention, the support frame includes first and second rail supports that are provided on respective ones of the opposing side sections. The first and second rail supports are designed to support corresponding first and second extensible rail assemblies which, in turn, slidably support the wash tub relative to the frame. In accordance with a more preferred form of the present invention, the support frame includes third and fourth rail supports so as to enable the dishwasher to include two wash tubs arranged in an upper and lower orientation.

In accordance with the most preferred form of the invention, the support frame is provided with a lid receiving element formed in each of the opposing side sections. Preferably, the lid receiving element is formed as part of the open lattice work. In any event, the lid receiving element is constructed so as to receive structure that positions a lid above the wash tub, while still accommodating vertical movement of the wash tub. In this manner, the support frame can be constructed so as to provide the specific structure required for supporting horizontally movable wash tubs requiring a minimal amount of material and manufacturing steps. In addition, by providing an open lattice work frame instead of a cabinet, the routing of hoses, wires and the like into and out of the appliance is advantageously enhanced.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENT

Figure 1:
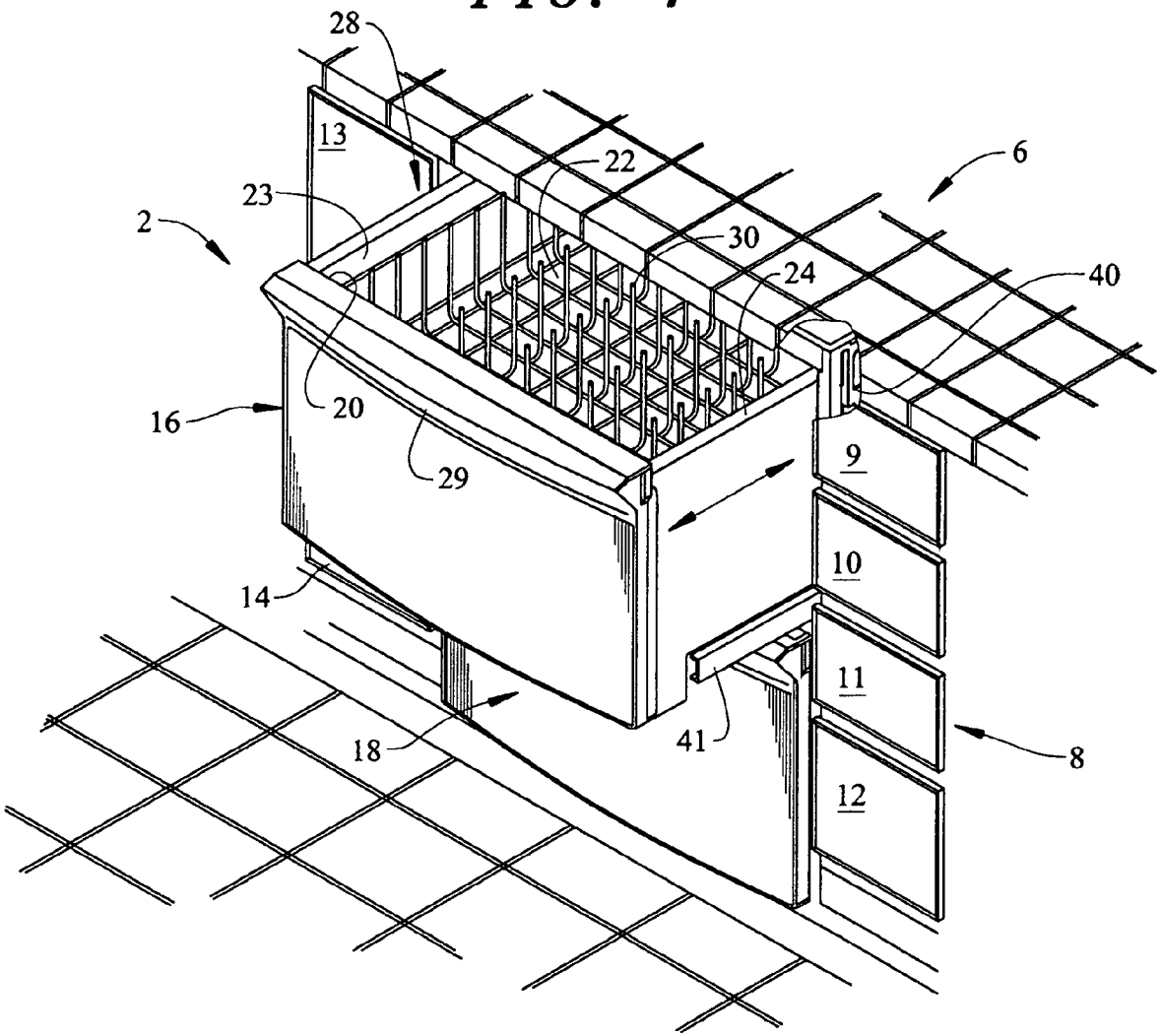
FIG. 1 is an upper right perspective view of a drawer-type dishwasher including upper and lower drawers supported within a molded plastic frame constructed in accordance with the present invention, with the dishwasher being positioned below a kitchen countertop.
Figure 2:
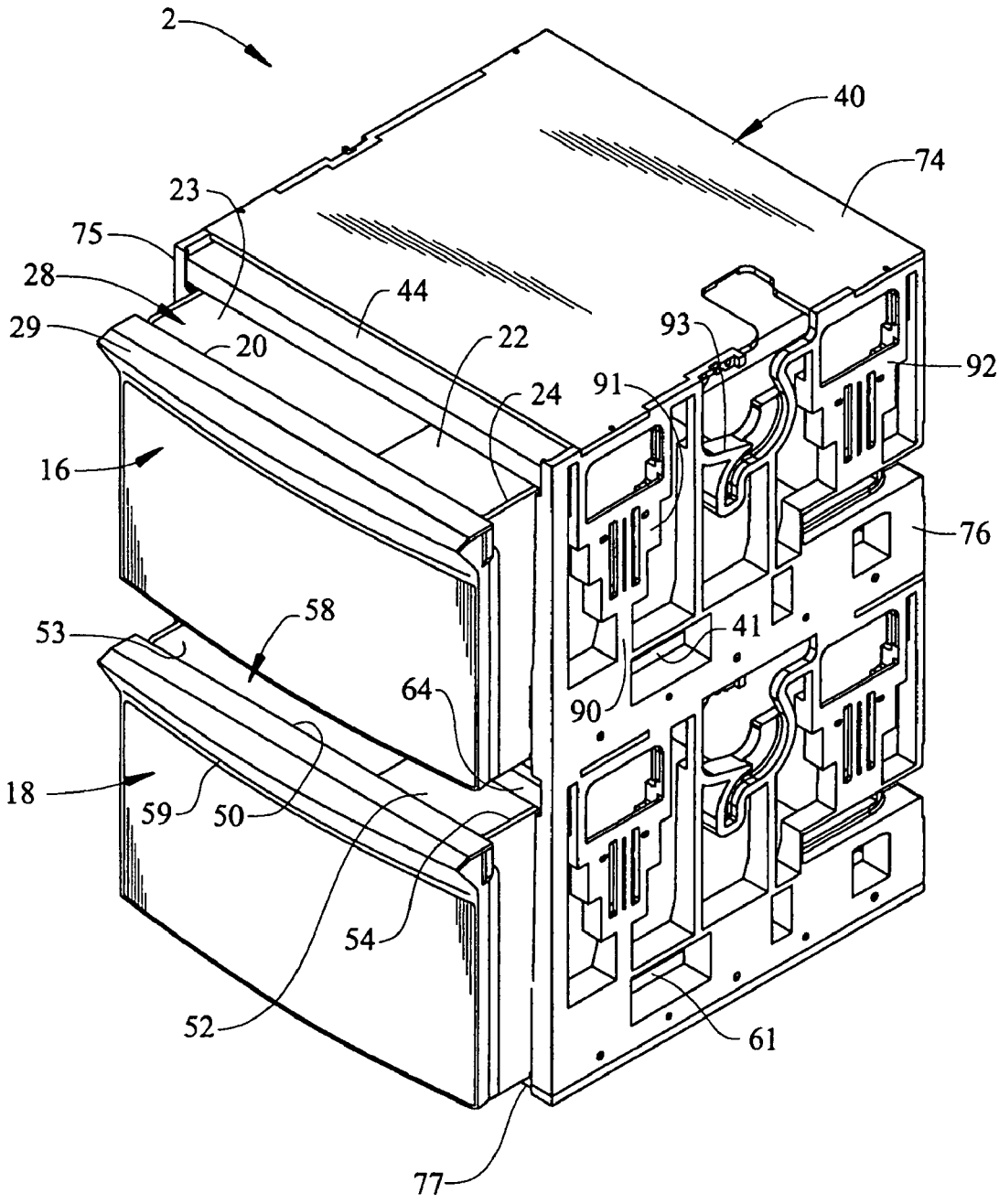
FIG. 2 is an upper right perspective view of the dishwasher of FIG. 1 removed from below the kitchen countertop, thereby exposing the molded support frame constructed in accordance with a first embodiment of the present invention.
Figure 3:
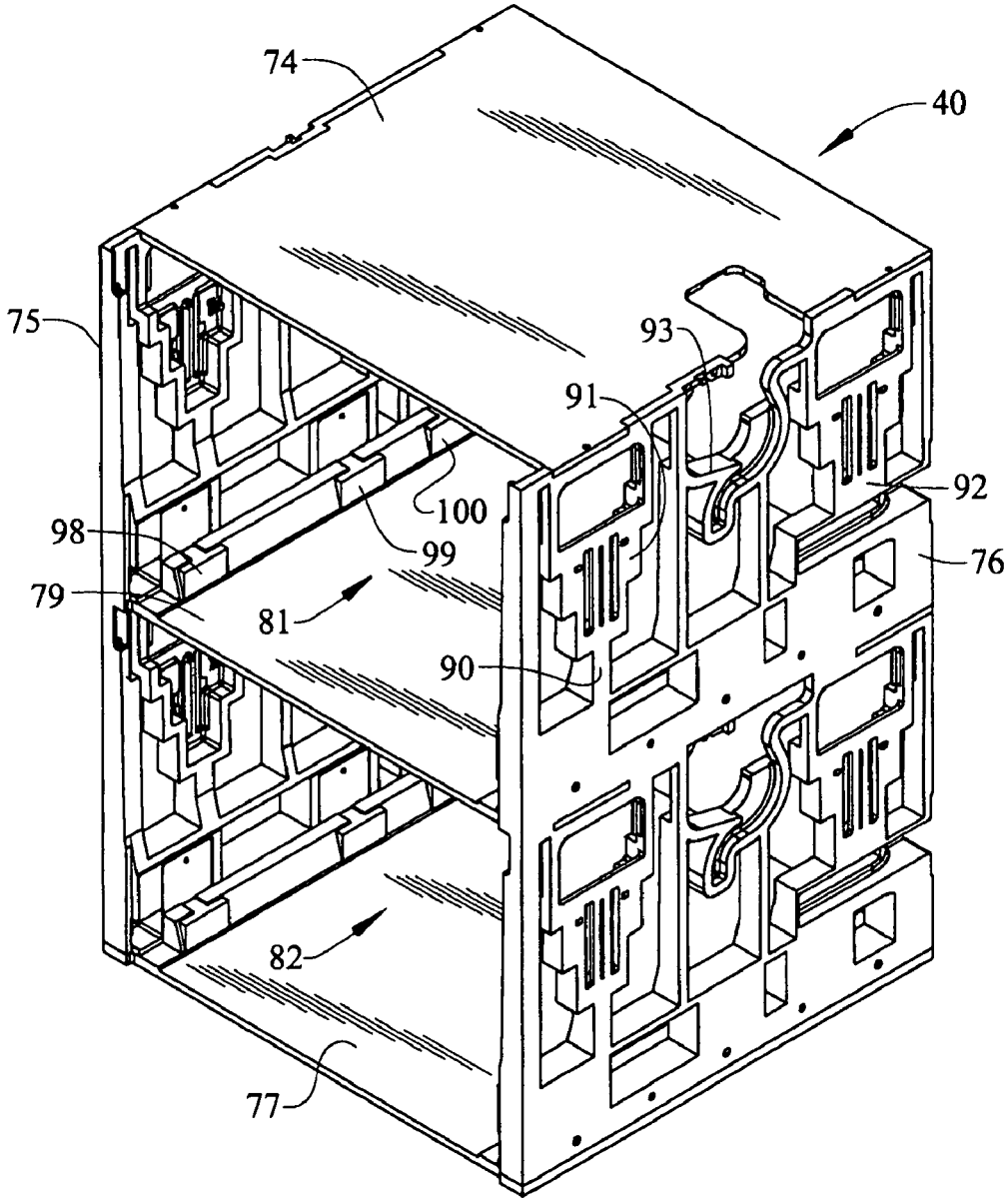
FIG. 3 is an upper right perspective view of the molded plastic frame of FIG. 2, illustrated with the upper and lower drawers removed.

With initial reference to FIGS. 1-3, a dishwasher constructed in accordance with the present invention is generally indicated at 2. As shown, dishwasher 2 is arranged below a kitchen countertop 6. Also below kitchen countertop 6 is shown cabinetry 8 including a plurality of drawers 9-12, as well as cabinet doors 13 and 14. Although the actual dishwasher into which the present invention may be incorporated can vary, the invention is shown in connection with dishwasher 2 depicted as a dual cavity dishwasher 2 having an upper drawer 16 and a lower drawer 18.

In accordance with the embodiment shown, upper drawer 16 includes a front wall 20, a rear wall (not shown), a bottom wall 22 and opposing side walls 23 and 24 that collectively define an upper wash chamber or tub 28. In a manner known in the art, upper drawer 16 is provided with a handle 29 for accessing tub 28. In a manner also known in the art, tub 28 includes a dish rack 30 for supporting various objects, such as glassware, utensils and the like, to be exposed to a washing operation. As will be discussed more fully below, upper drawer 16 is slidably mounted within a support frame 40 through a pair of extendible drawer support guides or rails, one of which is indicated at 41 in FIGS. 1 and 2. In addition, upper drawer 16 is provided with a vertically shiftable lid member 44 that is adapted to selectively seal against an upper portion (not separately labeled) of tub 28. That is, when upper drawer 16 is inserted into frame 40, lid member 44 is lowered to seal about tub 28 and, when drawer 16 is withdrawn from frame 40, lid member 44 is caused to be raised so as to enable drawer 16 to be withdrawn from frame 40 and provide access to tub 28. As the particular manner in which lid member 44 is raised or lowered is not part of the present invention, this aspect of dishwasher 2 will not be detailed further here.

In a similar manner, lower drawer 18 includes a front wall 50, a rear wall (not shown), a bottom wall 52 and opposing side walls 53 and 54 that collectively define a lower wash chamber or tub 58. In a manner known in the art, lower drawer 18 is provided with a handle 59 for accessing tub 58. In a manner similar to that described above, lower drawer 18 is slidably mounted within support frame 40 through a pair of extensible drawer support guides or rails, one of which is indicated at 61 in FIG. 2. In addition, lower drawer 18 is provided with a height shiftable lid member 64 which lowers to selectively seal lower drawer 18 when lower drawer 18 is inserted into frame 40, and raised when lower drawer 18 is to be withdrawn from frame 40.

In accordance with the first embodiment of the present invention, frame 40 includes a top frame section 74, opposing side frame sections 75 and 76, and a bottom frame section 77. In addition, frame 40 is provided with an intermediate frame section 79 that establishes an upper cavity 81 for receiving upper drawer 16 and a lower cavity 82 for receiving lower drawer 18. In further accordance with the embodiment shown, top frame section 74, side frame sections 75 and 76, bottom frame section 77 and intermediate frame section 79 are molded from plastic and thereafter joined or interconnected in order to create frame 40. In any event, as each of upper cavity 81 and lower cavity 82 is similarly constructed, a detailed description will be made with respect to upper cavity 81 with an understanding that lower cavity 82 includes corresponding structure.

As shown, upper cavity 81 includes a plurality of support members such as indicated at 90-93, that are arranged so as to establish an open lattice work for frame 40. Actually, support members 91 and 92 constitute lid support or receiving elements that are adapted to receive a mechanism (not shown) for shiftably supporting lid 44 above tub 28. More specifically, support members 91 and 92 are adapted to receive structure that mechanically interconnects to lid 44 so as to enable shifting of lid 44 when drawer 16 is inserted into or withdrawn from upper cavity 81. In addition, upper cavity 81 is provided with a plurality of rail supports, such as indicated at 98-100, that extend along opposing side frame section 75 adjacent intermediate frame section 79. Rail supports 98-100, in combination with an opposing plurality of rail supports (not shown) arranged upon opposing side frame section 76, provide structure to attach extensible support members 41 to provide the support and enable lateral movement of upper drawer 16 within upper cavity 81.

Figure 4:
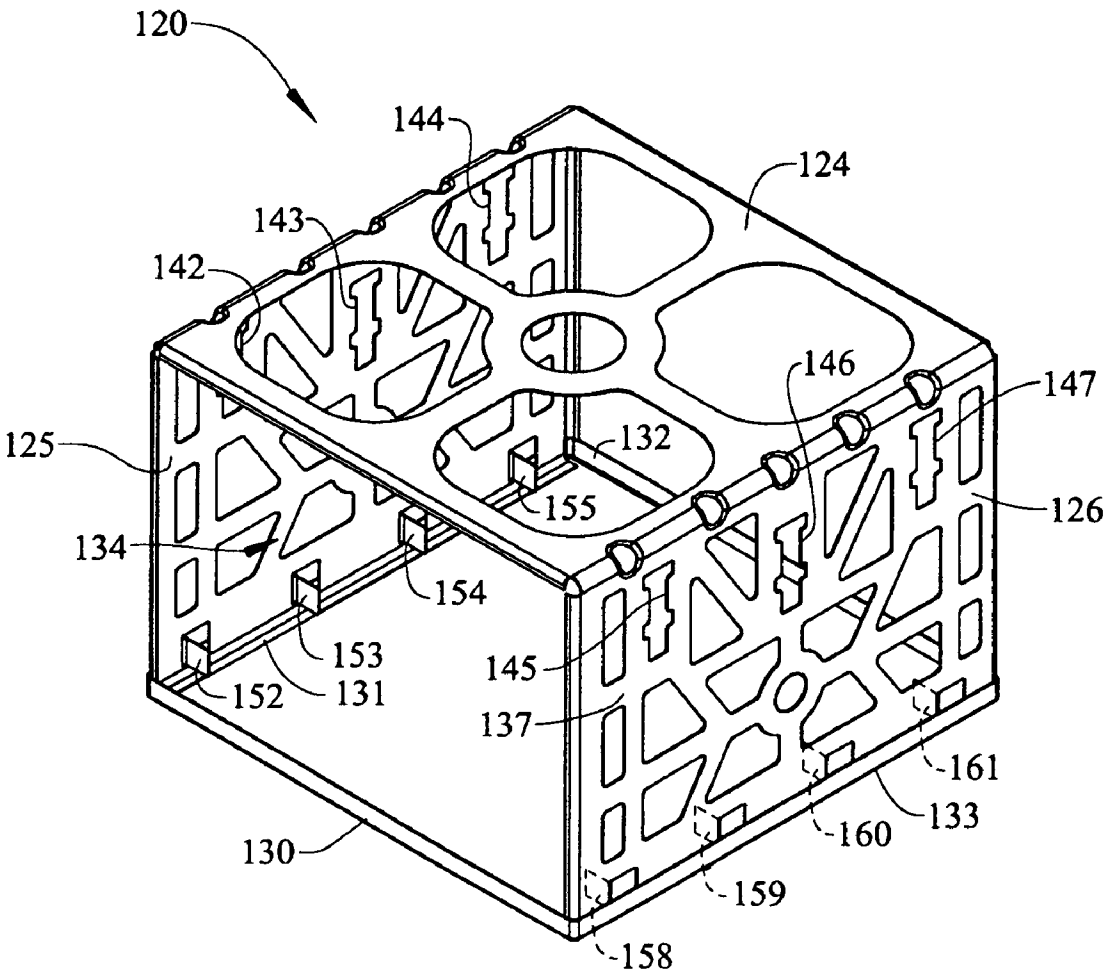
FIG. 4 is an upper right perspective view of the molded plastic support frame constructed in accordance with a second embodiment of the present invention.

Reference will now be made to FIG. 4 in describing a frame 120 constructed in accordance with a second embodiment of the present invention. As shown, frame 120 includes a top frame section 124 and opposing side frame sections 125 and 126 that are interconnected by a plurality of bottom frame members 130-133 to collectively define a cavity 134. In the embodiment shown, frame 120 is adapted to receive a single wash tub for mounting below a kitchen countertop. However, it should be understood that frame 120 could be interconnected with a second such frame 120 to form a dual wash unit. In any event, frame 120 is provided with a plurality of support members, such as indicated at 137, which define an open lattice work. Likewise, top frame section 124 is provided with a plurality openings (not separately labeled) that also establish an open lattice work. In accordance with the most preferred form of the embodiment shown, frame 120 is actually integrally molded of plastic so as to form a single, unitary piece.

In further accordance with the embodiment shown, support members 137 include a first plurality of lid support receiving elements 142-144 formed in or otherwise provided on side frame section 125, and a second plurality of lid support receiving elements 145-147 on side frame section 126. Lid support receiving elements 142-144 and 145-147 are adapted to interconnect with structure that positions an adjustable lid (not shown) above a washing chamber. Side frame section 125 is provided with a first plurality of rail supports 152-155 and, in a similar manner, opposing side frame section 126 is provided with a second plurality of rail supports 158-161. In the embodiment shown, rail supports 152-155 and 158-161 are constituted by flaps formed from support members 137 of side frame sections 125 and 126 which are bent inward through a hinge portion (not separately labeled). In a manner similar to that described above, rail supports 152-155 and 158-161 are adapted to interconnect with and support, for example, extensible rails (not shown) that enables a wash tub to laterally shift within cavity 134.

Figure 5:
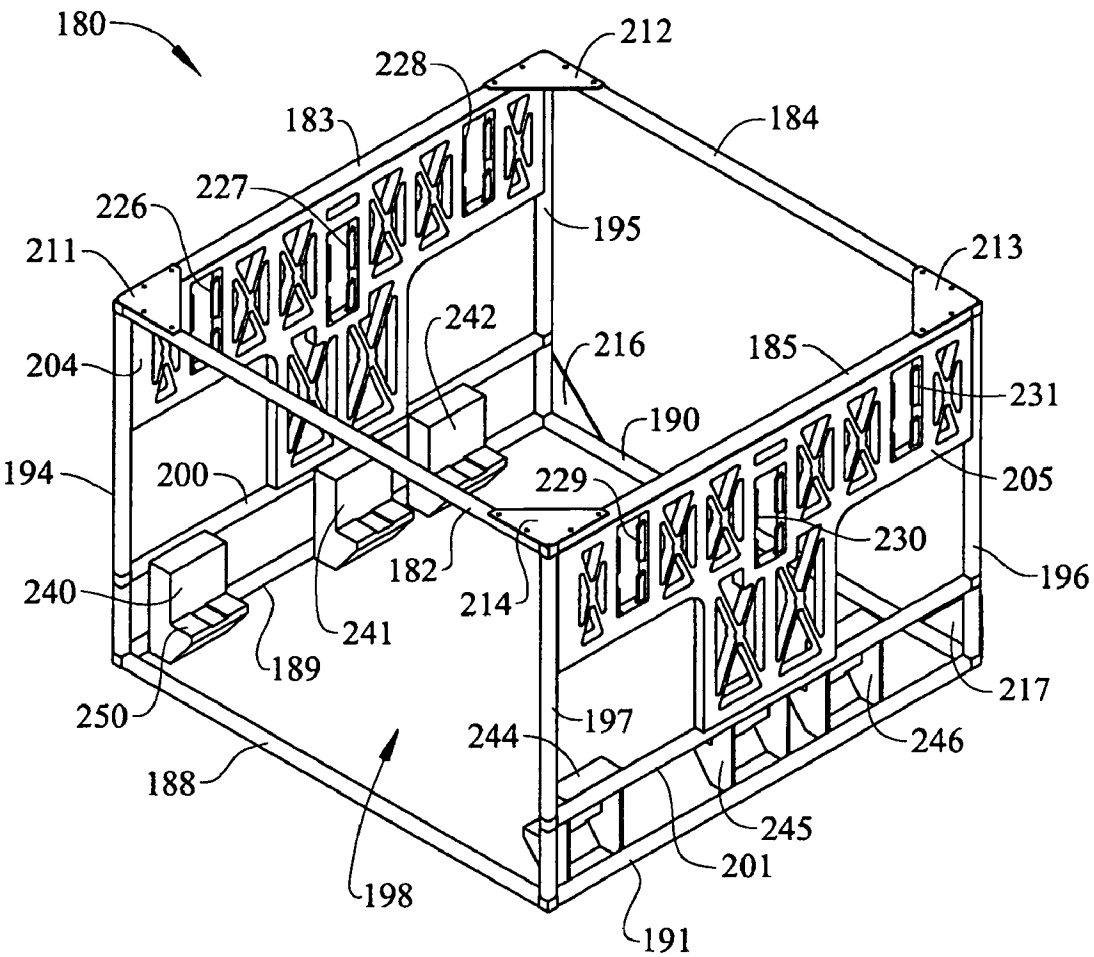
FIG. 5 is an upper right perspective view of the molded plastic support frame constructed in accordance with a third embodiment of the present invention.

Reference will now be made to FIG. 5 in describing yet another embodiment of the present invention. As shown, a frame 180 includes a plurality of top frame members 182-185, as well as a corresponding plurality of bottom frame members 188-191 that are interconnected by upright frame members 194-197 so as to define a cavity 198. In accordance with the embodiment shown, extending fore-to-aft between upright frame members 194 and 195 is a first cross member 200. Likewise, a second cross member 201 is provided between upright frame members 196 and 197. In still further accordance with the embodiment shown, frame 180 is provided with a pair of opposing side walls that are constituted by support members 204 and 205 which are generally T-shaped. Support members 204 and 205 interconnect respective ones of top frame members 183 and 185 with a corresponding one of first and second cross members 200 and 201. In a manner similar to that described above, support members 204 and 205 include a plurality of openings (not separately labeled) that define an open lattice work. In addition, in order to provide additional structural support for frame 180, top frame members 182-185 are provided with a plurality of corner stiffeners or gussets 211-214. Likewise, additional gussets 216 and 217 are provided to interconnect bottom frame member 190 with upright frame members 195 and 196 respectively.

In a manner also similar to that described above with respect to the previous embodiments, support members 204 and 205 are provided with a plurality of lid support elements 226-228 and 229-231 respectively. Lid support elements 226-228 and 229-231 are adapted to interconnect with structure that movably supports a lid member. Likewise, frame 180 is provided with a plurality of rail supports, such as indicated at 240-242 and 244-246, for supporting extensible or guide rails that enable a washing chamber (not shown) to shift into and out of chamber 198. In accordance with the embodiment shown, rail supports 240-242 are connected to frame 180 between first cross member 200 and bottom frame member 189. Likewise, rail supports 244-246 are connected between second cross member 201 and bottom frame member 191. Also shown, each rail support 240-242 and 244-246 is provided with a substantially horizontal surface 250 to which is adapted to mount a respective extensible rail.

Figure 6:
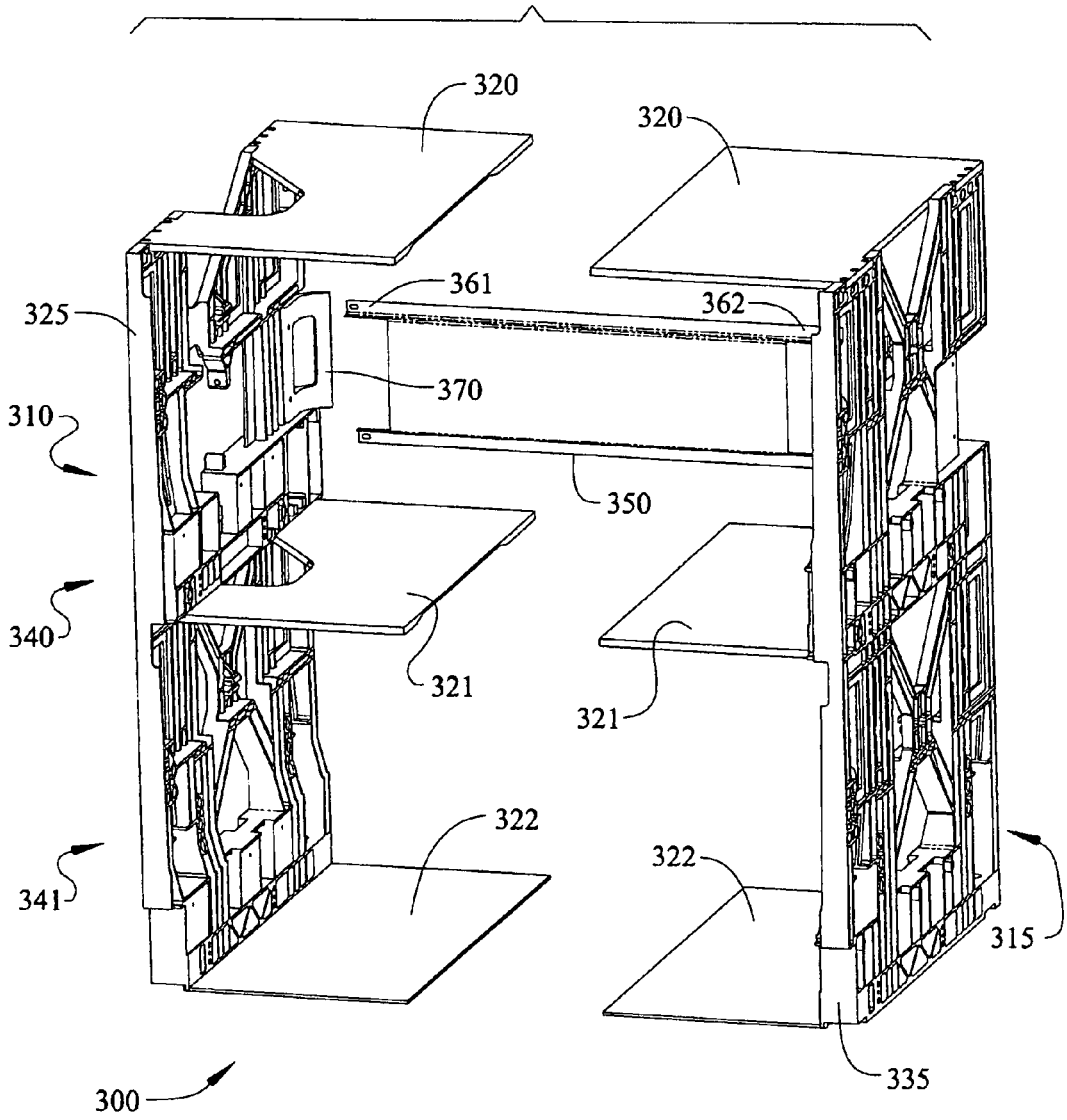
FIG. 6 is a perspective view of a molded support frame constructed in accordance with a fourth embodiment of the invention.
Figure 7:
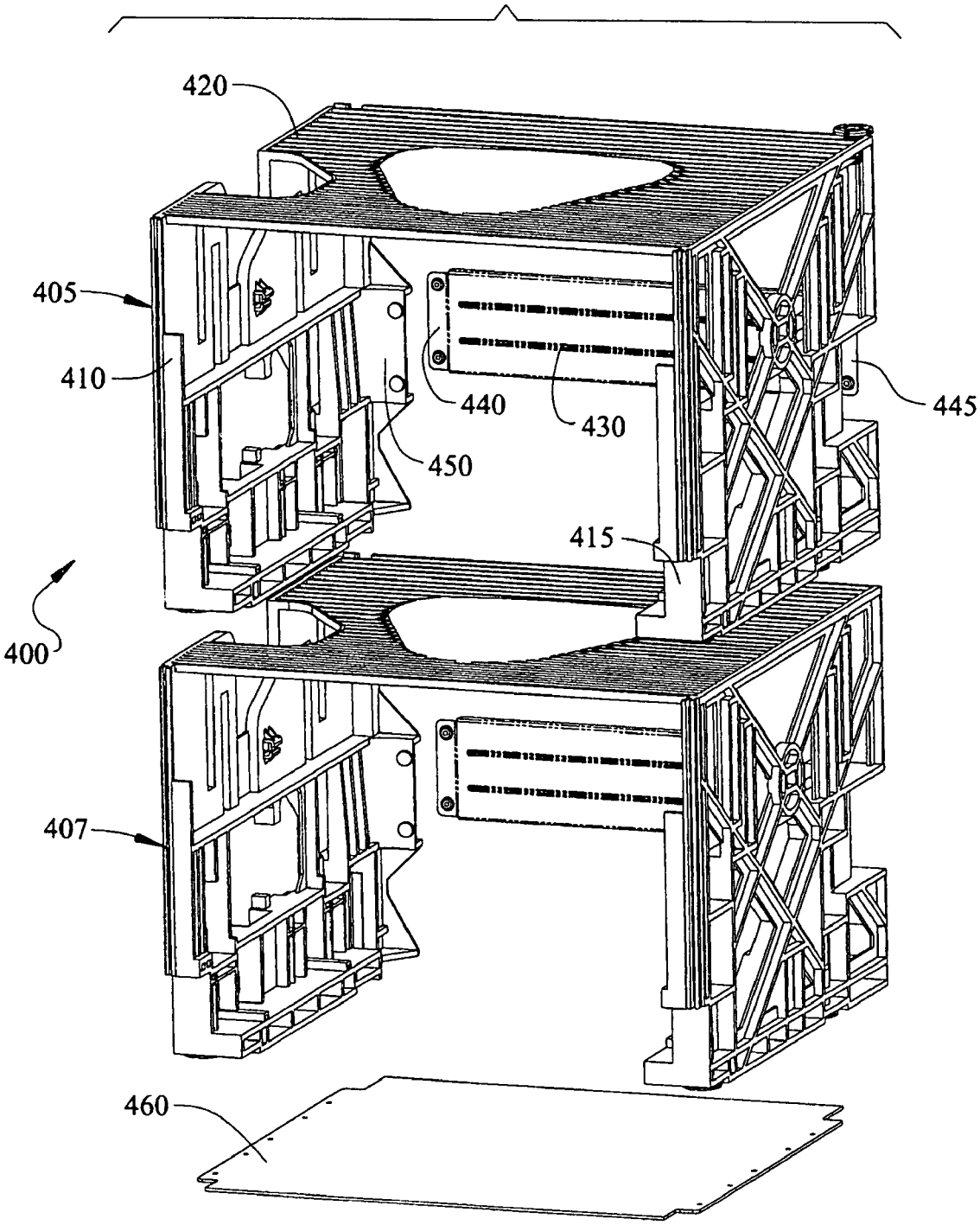
FIG. 7 is a perspective view of a molded support frame constructed in accordance with a fifth embodiment of the invention.

Reference will now be made to FIGS. 6 and 7 in describing still further embodiments of the present invention. As best shown in FIG. 6, a dishwasher support frame 300 includes first and second side frame portions 310 and 315. As shown, a top frame section 320, an intermediate frame section 321 and a base frame section 322 extend between a side frame section 325 and a side frame section 335. In accordance with the embodiment shown, first and second side frame portions 310 and 315 are interconnected so as to form the overall frame assembly 300 having upper and lower cavities 340 and 341. In order to provide additional structural support for frame 300, a rear frame member 350 interconnects first and second side frame portions 325 and 335. More specifically, rear frame member 350 includes first and second end portions 361 and 362 which are joined to corresponding rear member receiving portions, one of which is shown at 370, formed in side frame sections 325 and 335.

FIG. 7 illustrates a dishwasher frame 400 constructed in accordance with yet another embodiment of the invention. Actually, dishwasher support frame 400 is a stackable frame unit which can be employed in a dual compartment dishwasher or a single compartment dishwasher depending upon the particular configuration desired. In any case, dishwasher support frame 400 is shown to include an upper support frame 405 and a lower support frame 407. However, as each support frame 405 and 407 is constructed similarly, a detailed description will be made with support frame 405 with an understanding that support frame 407 is correspondingly constructed. As shown, support frame 405 includes first and second opposing side frame sections 410 and 415 which are preferably joined by a top frame section 420. In order to provide additional structural support, a rear frame member 430 interconnects first and second opposing side frame sections 410 and 415. More specifically, rear frame member 430 includes first and second end portions 440 and 445 which are mechanically fastened to rear frame member receiving portions, one of which is shown at 450.

As illustrated, support frame 405 is stacked or mounted to support frame 407 to form a dual cavity dishwasher. Thus, support frame 407 is provided with a base frame section 460 which serves as a base or bottom for the overall dishwasher. However, it should be understood that base frame section 460 could be simply mounted to support frame 405 in the event that a single cavity dishwasher is desired. It should also be understood that, while not labeled, each support frame 300, 405 and 407 of the embodiments of FIGS. 6 and 7 is provided with rail supports for mounting extensible glide rails that shiftably support upper and lower drawers 16 and 18 in a manner directly corresponding to that described above with respect to the embodiments of FIGS. 1-5.

In connection with each of the disclosed embodiments, it should be apparent that the support frame of the present invention provides an easy to manufacture, light weight construction that will provide all the structural integrity required to support shiftable drawers or wash tubs for a drawer type dishwasher. Although described with reference to preferred embodiments of the present invention, it should be readily apparent to one of ordinary skill in the art that various changes and/or modifications can be made to the invention without departing from the spirit thereof. For instance, the support frame can be fashioned so as to support one, two or more wash tubs without departing from the scope of the present invention. In addition, while the extensible support rails are designed to be attached to side walls of the wash tub, attachment to the bottom wall is equally acceptable. Furthermore, it should be realized that each frame portion or section is preferably molded as a unitary piece (except gussets 211-214 and rear frame members 350 and 430 which are preferably made of metal), but could be made from separate pieces that are interconnected. In general, the invention is only intended to be limited by the scope of the following claims.

We claim:

1. A dishwasher comprising:

a drawer defining a wash tub;

a lid positioned above the wash tub for sealingly engaging the wash tub during a washing operation; and a support frame including interconnected, opposing side frame sections formed from a plurality of plastic members molded into an open latticework, a top frame section interconnecting upper portions of the opposing side frame sections, and first and second rail supports provided on the opposing side frame sections respectively, for use in supporting the drawer for movement into and out of a cavity defined by said opposing side frame and top frame sections enveloping the drawer, with said lid being located in the cavity and beneath the top frame section.

2. The dishwasher according to claim 1, further comprising: first and second extensible rails mounted on the first and second rail supports respectively and interconnected to the drawer to slidably mount the wash tub relative to the support frame for movement between a first position, wherein the wash tub is recessed within the cavity, and a second position, wherein a portion of the wash tub projects from the cavity to allow loading and unloading of dishware.

3. The dishwasher according to claim 1, wherein the top frame section also constitutes an open lattice work molded of plastic.

4. The dishwasher according to claim 1, wherein the top frame section is formed from a single sheet of plastic material so as to define a substantially horizontal planar web.

5. The dishwasher according to claim 1, wherein the support frame further includes a base frame section joined to lower portions of each of the opposing side frame sections.

6. The dishwasher according to claim 5, wherein the base frame section is formed from a solid sheet of plastic material.

7. The dishwasher according to claim 1, wherein the support frame further includes a base frame section joined to lower portions of each of the opposing side frame sections, wherein the top frame section, the opposing side frame sections and the base frame section are integrally molded so as to form a single one-piece frame unit.

8. The dishwasher according to claim 1, further comprising:

an intermediate frame section joined to each of the opposing side frame sections, said intermediate frame section being spaced from the top frame section such that the cavity is arranged between the top frame section and the intermediate frame section;

another cavity arranged below the intermediate frame section; and a second drawer mounted in the another cavity.

9. The dishwasher according to claim 8, wherein the intermediate frame section is formed from a single sheet of plastic material so as to define a substantially horizontal planar web.

10. The dishwasher according to claim 8, further comprising:

third and fourth rail supports provided on the opposing side frame sections in the another cavity; and third and fourth extensible rails mounted to the third and fourth rail supports respectively and slidably supporting the second drawer in the another cavity.

11. The dishwasher according to claim 10, wherein each of the first, second, third and fourth rail supports are integrally formed with the opposing side frame sections.

12. The dishwasher according to claim 1, further comprising:

a lid support receiving element provided on each of the opposing side sections in the cavity, each said lid support receiving element being adapted to position the lid above the wash tub.

13. The dishwasher according to claim 12, wherein each said lid support receiving element accommodates vertically shifting of the lid relative to the lid support receiving element.

14. The dishwasher according to claim 1, wherein the support frame further includes a rear frame member extending between and interconnecting each of the side frame sections.

* * * * *